United States Patent [19]

Pike

[11] Patent Number: 4,734,838

[45] Date of Patent: Mar. 29, 1988

[54] NON-ABRASIVE CLUTCH FOR PHARMACY STYLE LAMPS

[75] Inventor: Louis D. Pike, Moreland Hills, Ohio

[73] Assignee: Pike Machine Products, Cleveland, Ohio

[21] Appl. No.: 34,634

[22] Filed: Apr. 6, 1987

[51] Int. Cl.[4] ..... F21M 18/00

[52] U.S. Cl. ..... 362/427; 362/287; 362/242

[58] Field of Search ..... 362/427, 287, 242; 248/125, 405

[56] References Cited

U.S. PATENT DOCUMENTS

| | | | |
|---|---|---|---|
| 2,950,892 | 8/1960 | Rick | 248/242 |
| 4,386,393 | 5/1983 | Pike | 362/427 |
| 4,449,172 | 5/1984 | Warshawsky | 362/427 |
| 4,459,650 | 7/1984 | Pike | 362/427 |
| 4,484,255 | 11/1984 | Warshawsky | 362/427 |
| 4,605,995 | 8/1986 | Pike | 362/287 |

OTHER PUBLICATIONS

I. W. Industries Catalog No. 1883, pp. 68–71.

*Primary Examiner*—E. Rollins Cross

*Attorney, Agent, or Firm*—Fay, Sharpe, Beall, Fagan, Minnich & McKee

[57] ABSTRACT

A lighting socket assembly (16) is mounted on an upper end of an L-shaped slide tube (A), such as a brass tube. A one piece, plastic clutch block (30) defines a cylindrical bearing surface (32) integrally therewith. The L-shaped tube lower portion (10) is slidably and rotatably received in frictional engagement with the cylindrical bearing surface such that the tube is slidable and rotatable therein. A threaded member (40) is threadly received in a bore (38) in the clutch block. A smooth inner surface (48) of the threaded member selectively engages the received L-shaped tube to adjust the degree of frictional engagement between the clutch block and the tube. By selectively advancing and retreating the threaded element with a manually graspable portion (46) rotational and vertical adjustment of the lamp assembly relative to the clutch block is facilitated. The clutch block is supported on a vertical rod or tube (60) which is mounted to a base (62). A spacer member (70) defines a pair of vertical passages (72, 74), one of which receives the support tube and the other of which receives the slide tube.

20 Claims, 6 Drawing Figures

NON-ABRASIVE CLUTCH FOR PHARMACY STYLE LAMPS

BACKGROUND OF THE INVENTION

The present invention pertains to the art of swivel joints. It finds particular application in conjunction with swivel joints for pharmacy style lamps and will be described with particular reference thereto. It is to be appreciated, however, that the invention may also be applicable to other styles of lamps and other pivotal connections and joints.

Heretofore, pharmacy lamps have commonly included a brass or brass plated steel clutch body which was mounted to a vertical table or floor supported rod. A relatively large diameter passage extended vertically through the clutch body to receive a lower end of an L-shaped metal slide tube which supported a lamp fixture at an upper end thereof. The slide tube was commonly brass or brass plated and lacquered to prevent tarnishing. In order to prevent the clutch housing from scratching and abrading the brass L-shaped slide tube, a plastic sleeve was received within the metal clutch housing to provide a bearing surface. An annular bushing was press fit into one or both ends of the bore to hold the plastic bushing sleeve in place. A knurled metering screw was received in a threaded bore of the clutch housing that extended generally tangentially to the slide tube passage. A rotation of the knurled metering screw caused an angled point to cam against and deform the plastic bushing sleeve. In this manner, rotation of the knurled metering screw selectively controlled the cross section of the bushing sleeve which, in turn, selected the degree of friction with which the brass slide tube was held in the clutch passage.

In any other pharmacy lamp style, the cap for retaining the bushing sleeve within the bore was threaded to the clutch member. Rotation of the cap selectively pressed the sleeve into a cam surface or otherwise compressed it. This selective compression again deformed the clutched sleeve to change its cross section, hence, the degree of frictional engagement with the brass slide tube.

One of the problems with the prior art pharmacy style lamps resided in the complexity of manufacture. In addition to the cost of the many parts, corresponding labor costs were incurred to assemble the separate plastic bushing sleeves into the clutch housing and to anchor it with one or more press bushings or threaded clutch caps.

Another problem with the prior art pharmacy style lamps resided in the tendency for the slide rod to become scratched and marred due to the inadvertent contact with metal parts. Such damage was particularly likely if the plastic sleeve broke or fractured. If the metering screw was screwed down until it pierced or split the plastic sleeve, extensive gouging and damage could occur. Further, rough handling could flex the slide tube into contact with the press bushings or threaded cap for holding the plastic bushing sleeve in place.

The present invention contemplates a new and improved clutch assembly for pharmacy style lamps which overcomes the above referenced problems and others.

SUMMARY OF THE INVENTION

In accordance with one aspect of the present invention, a one piece clutch block defines a cylindrical, non-abrasive bearing surface which is integral and unitary therewith. In one embodiment, the clutch block and the bearing surface are integrally constructed by machining from a single block of plastic material such as nylon, delron, acrylic, or the like. In this manner, separate bearing sleeves, press bushings, and the like are eliminated.

In accordance with another aspect of the present invention, a metering or thumb screw extends through a threaded bore in the clutch block which is perpendicular to a central axis of the cylindrical bearing surface. At least the inner end of the metering screw is non-abrasive. Preferably, the metering screw is machined from the same or a similar plastic material as the clutch block.

In accordance with another aspect of the present invention, the clutch block is constructed of a plastic which is pigmented with a finished color. For example, the plastic might be matte black, semi-transparent, or any of a multiplicity of colors. Alternately, the plastic clutch block may be powder coated with substantially any color which might be desired, brass or chrome plated, or the like.

In accordance with a more detailed aspect of the present invention, a pharmacy style lamp assembly is provided. A slide tube with a scratchable surface finish has a generally vertical lower portion and a lighting socket connected with an upper portion. The upper and lower slide tube portions define an internal path through which a power cord extends. A clutch block is constructed completely of a non-abrasive material which is sufficiently softer than the slide tube finish that the finish is not scratched by sliding interaction with the clutch block. The clutch block defines a vertical slide tube passage therethrough in which the lowered tube portion is rotatably and slidably received. The vertical passage is integrally defined by the non-abrasive clutch block material such that the slide tube finish is not scratched during rotating or sliding. In this manner, separate bushing sleeves and associated parts are eliminated.

In accordance with a yet more limited aspect of the invention, a metering screw or other threaded member extends through a threaded passage in the clutch block into the slide tube passage. The threaded member has at least an inner end which is non-abrasive for engaging the slide tube lower portion without scratching its finish. In this manner, the frictional engagement between the threaded member and the slide tube is selectively adjustable to facilitate or retard rotational and vertical sliding movement of the slide tube within the clutch body without damage to the slide tube.

A first advantage of the present invention is that it simplifies and reduces the cost of clutch assemblies for pharmacy style lamps.

Another advantage of the present invention is that it provides increased color flexibility.

Another advantage of the present invention is that it reduces scratching and abrasive damage to the slide tubes of pharmacy style lamps.

Further advantages will become apparent to those of ordinary skill in the art upon reading and understanding of the following detailed description of the preferred embodiments.

BRIEF DESCRIPTION OF THE DRAWINGS

The invention may take form in various parts and arrangements of parts. The drawings are only for purposes of illustrating preferred embodiments and are not to be construed as limiting the invention.

DETAILED DESCRIPTION OF THE PREFERRED EMBODIMENT

Figure 1:
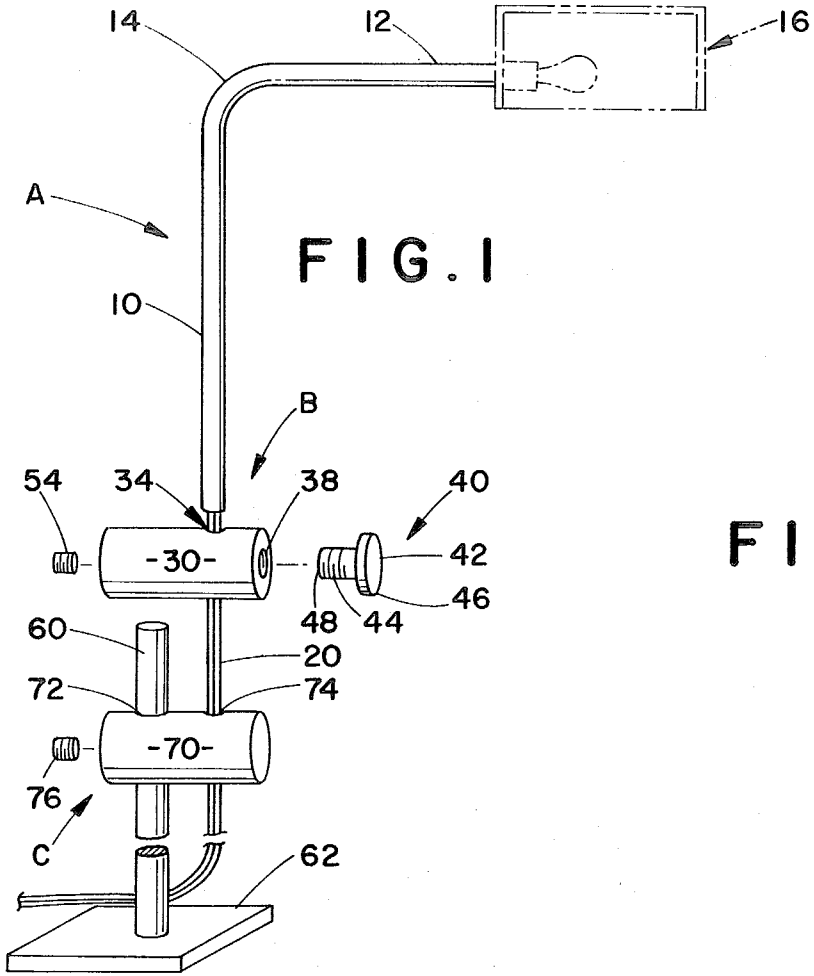
FIG. 1 is an exploded view of a pharmacy lamp in accordance with the present invention.

With reference to FIG. 1, an L-shaped slide tube A which is adapted to support a lighting socket is slidably and rotatably received through a clutch assembly B. A supporting means C supports the clutch assembly on an associated structure, such as a table, floor, wall, or the like.

Figure 2:
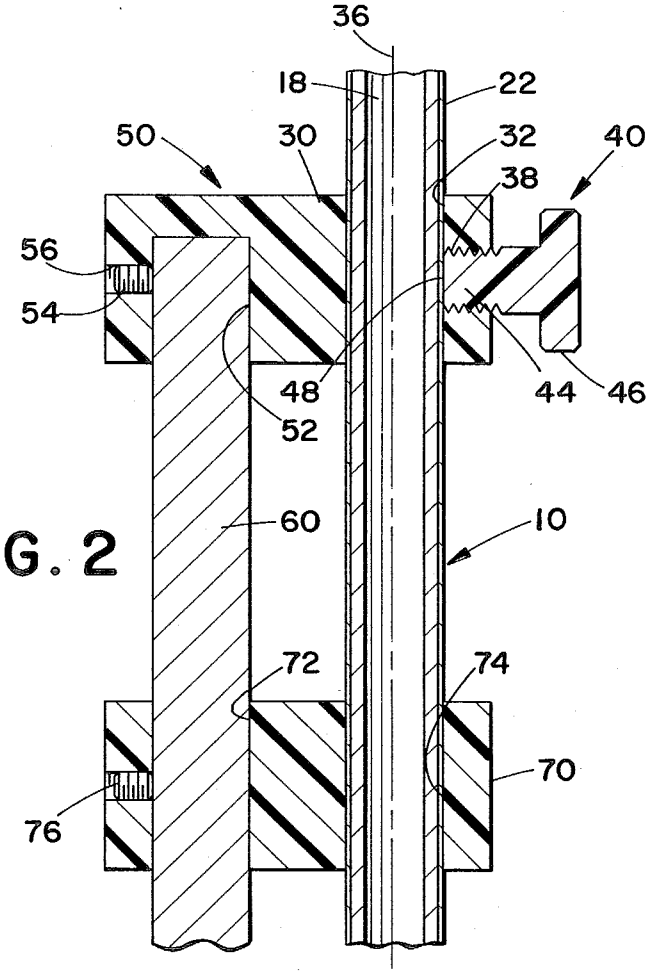
FIG. 2 is a cross sectional view through a vertical plane of the clutch block of the assembled lamp of FIG. 1.

With continuing reference to FIG. 1 and further reference to FIG. 2, the L-shaped slide tube A includes a lower portion 10 and an upper portion 12 which are interconnected by a 90° bend 14. The upper portion 12 supports a lighting fixture 16 such as a downward directed U-shaped shade in which a light bulb receiving socket is mounted. The slide tube A defines an internal path 18 therethrough between its upper and lower ends. A power cord 20 extends through the slide tube to the lighting fixture 16. In the illustrated embodiment, the power cord is exposed below the slide tube lower end. Optionally, the power cord may be concealed in the supporting means C.

In the preferred embodiment, the slide tube is brass with a polished, satin, or antique brass finish. A lacquer or other protective coating 22 is applied to the brass finish to inhibit oxidation and tarnishing. Optionally, the slide tube may be steel which has been brass plated and lacquered. Alternately, the coating 22 may be a layer of chrome which has been electroplated and polished.

The present invention also contemplates non-metallic slide tubes with metallic and non-metallic coatings. For example, the slide tube may be a plastic material on which a metal coating has vacuum deposited, electroplated, or the like. Alternately, the plastic may be painted or coated using a powder coating, electrostatic spray, or like coating process. As yet another option, the slide tubes may be two layers of co-extruded plastic, the outer of which carries a selected pigmentation. For example, the slide tube primary component may be a relatively thick layer of extruded black plastic which is high in carbon black filler to provide excellent stabilization against utraviolet degradation. A plastic composition with a desired color but less stabilizing filler may extend around the black plastic slide tube portion.

With continuing reference to FIGS. 1 and 2, the clutch assembly B includes a unitary clutch block 30 which is fabricated, preferably machined, of a non-abrasive material. That is, the non-abrasive material is selected to be softer than or otherwise non-abrasive relative to the slide tube surface or its coating 22. Suitable materials for the clutch block include nylon, delron, acrylic, other plastics, and the like. A machinable plastic is preferred. A plastic material which is amenable to plating, powder coating, or receiving colored pigments is preferred.

The clutch block defines a cylindrical bearing surface 32 which defines a slide tube receiving vertical passage 34 extending vertically through the clutch block along a central axis 36. The outer surface of the slide tube and the cylindrical bearing surface fit with a relatively close tolerance such that the slide tube slides and rotates smoothly in the vertical passage without significant wobble or play. The clutch block 30 further includes a threaded bore 38 which extends therethrough in communication with the vertical passage and perpendicular to the central axis 36.

A non-abrasive frictional engagement adjusting means 40 selectively adjusts the degree of frictional interaction between the slide tube A and the clutch block 30. In the preferred embodiment, the friction adjusting means includes a threaded member 42 having an inner end 44 constructed of the non-abrasive material and a manually graspable portion 46 at an outer end thereof. An inner slide tube engaging surface 48 of the threaded member has a smooth, planar surface which interacts directly with the slide tube. Preferably, the engaging surface is smooth and free of ridges, points, and projections which could scratch or mar the slide tube coating 22 as the threaded member is rotated into the threaded bore 38 or as the slide tube is slid or rotated relative to the threaded member. The threaded member may be constructed in one piece of the same non-abrasive material as the clutch block. However, to compensate for the additional pressure and the rotational mode of movement it may be constructed with the inner end of a material which is even less abrasive or softer than the clutch block.

The clutch block further includes a mounting means 50 for mounting the clutch block to the supporting means C. In the embodiment of FIGS. 1 and 2, the mounting means includes a mounting bore 52 defined in the clutch block 30 parallel to the central axis 36. An achoring means, such as a set screw 54 received in an intersection passage, locks the support structure C in the support structure mounting bore 52.

In the embodiment of FIGS. 1 and 2, the support means C includes a vertical rod or tube 60 which is received in the mounting bore 52. An appropriate base 62 mounts the vertical support rod 60 on a floor or table.

A guide member 70 of the non-abrasive material assists in maintaining the alignment between the support rod 60 and the slide tube A. The guide member defines parallel apertures or bores 72 and 74 which conform to the outer diameters of the support rod and the slide tube, respectively. An anchoring means, such as a set screw 76, anchors the guide member 70 to one of the support rod and the slide tube. The other is slidably received in the guide member.

Figure 3:
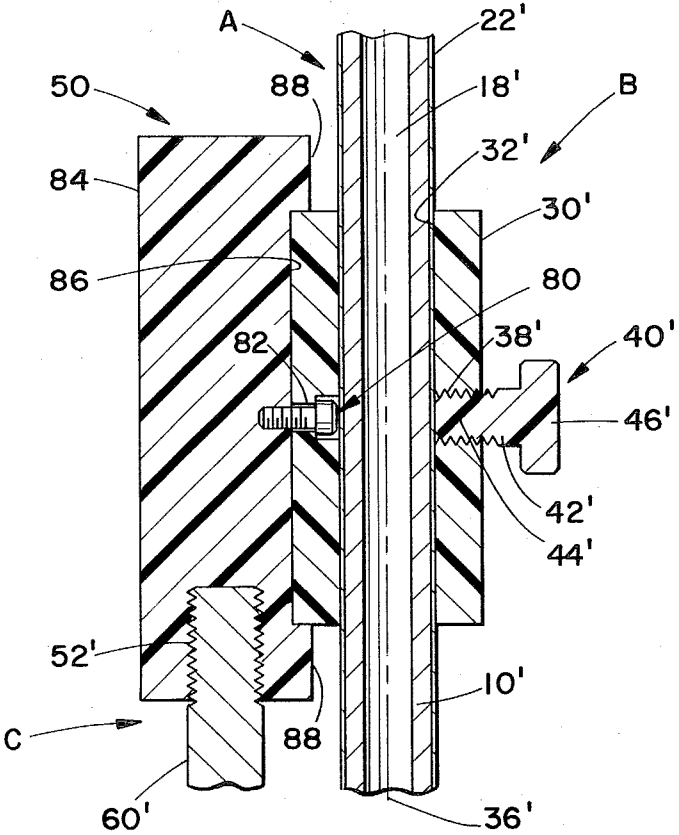
FIG. 3 is a vertical section through an alternate embodiment of the clutch block and associated supporting structure.

In the embodiment of FIG. 3, like elements with the embodiment of FIGS. 1 and 2 are denoted by the same reference numeral but followed by prime (′). The clutch includes a unitary clutch block 30′ which defines a cylindrical bearing surface 32′ that closely approximates the exterior diameter of the slide tube A. A frictional interaction adjusting means 40′ includes a threaded member 42 which selectively engages the slide tube to lock its position relative to the clutch block.

The clutch block is mounted to the support means C by a mounting means 50'. The mounting means includes a fastener 80 which passes through a bore 82' in the clutch block to mount the clutch block 30' to a mounting element 84. The fastening means bore 82 is disposed in axial alignment with the threaded bore 38' such that the faster 80 can be applied therethrough. The mounting element 84 defines a clutch block receiving recess 86 between cylindrical end portions 88. An appropriate adhesive bonding agent, such as a plastic solvent, resin, glue, adhesive, or the like, is applied between the clutch block and the mounting element 84. The fastening means 80 fastens the clutch block and the mounting element 84 in a fixed alignment until the bonding agent sets. With an appropriate bonding agent, jigs, and the like, the clutch block and the mounting element 84 can be bonded accurately in preselected alignment without the use of the fastener 80.

The support means C includes a vertical rod or tube member 60' which is received in a supporting means receiving bore 52' of the mounting element. An anchoring means, such as a threaded end of the tube 60' and threads in the bore 52', interconnect the support means C with the mounting element 84.

Figure 4:
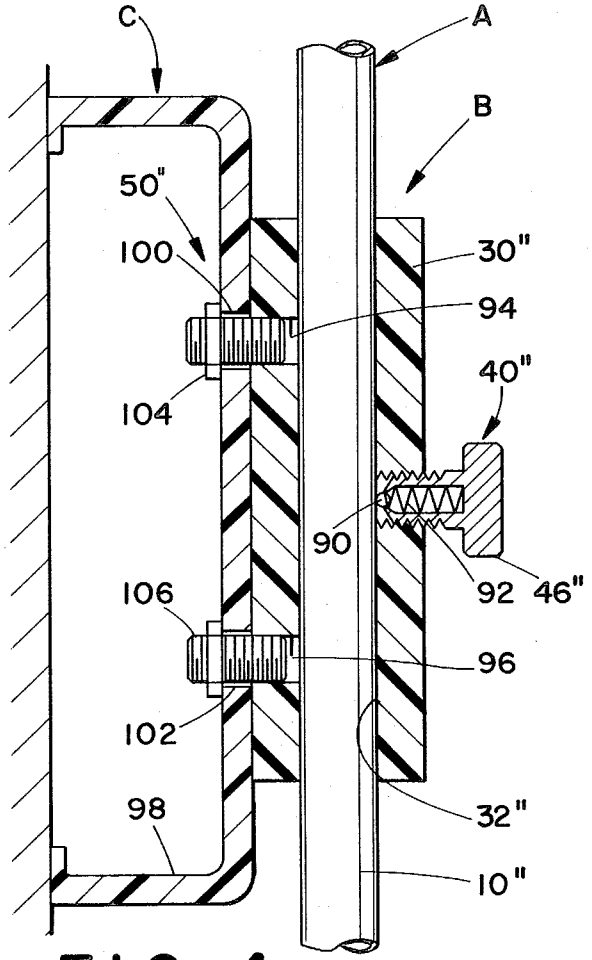
FIG. 4 is a vertical section of another alternate embodiment.

In the alternate embodiment of FIG. 4, like elements with the embodiment of FIGS. 1 and 2 are denoted by the same reference numberal but followed by a double prime (''). The clutch B includes a unitary clutch block 30'' which integrally defines a cylindrical bearing surface 32'' therein that closely approximates the exterior diameter of the slide tube A. This provides a frictional, yet sliding and rotational fit therebetween. A frictional interaction adjusting means 40'' includes a threaded member 42'' which has a roller or ball element 90 received at an inner end thereof. The ball element is biased by a spring 92 toward contact with the slide tube A. A manually graspable portion 46' moves the ball 90 into greater and lesser frictional engagement with the slide tube. Alternately, the manually graspable portion may change the compression of the spring 92 to adjust the bias on the ball element, a sliding engagement element, or the like.

Other frictional engagement adjusting means are also contemplated. For example, the threaded member and the clutch block may be interconnected such that rotation of the threaded member deforms the cylindrical bearing surface. The threaded member might compress or flatten the cylindrical bearing surface to increase the amount of frictional engagement.

A mounting means 50'' includes a first threaded bore 94 and a second threaded bore 96 extending in axial alignment through or partially through the clutch block 30''. A wall plate 98 defines like threaded bores 100 and 102 in axial alignment with the clutch block threaded bores 94 and 96. Threaded members such as threaded nipples 104 are received in the threaded bores 94 and 96. Lock nuts anchor the threaded nipples, hence unitary clutch block 30'', to the wall mounting bracket 98 or other supporting structure.

As another alternative, the vertical passage 34'' may extend only part way through the clutch block such that the slide tube A only extends upward from the clutch block. The wire may pass from the slide tube through the lower threaded nipple 106.

Figure 5:
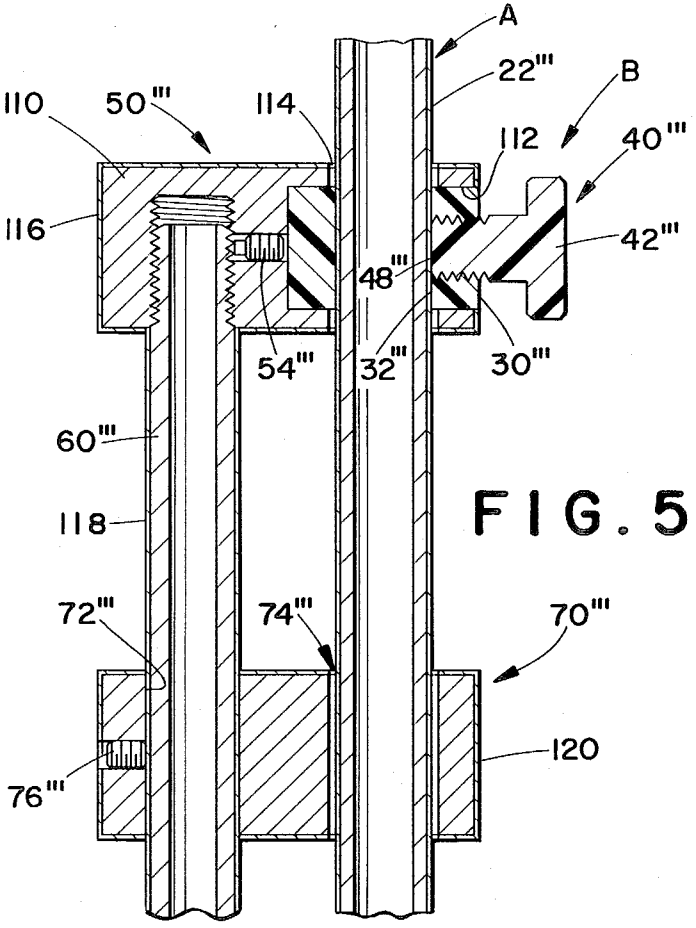
FIG. 5 is a vertical section of yet another alternate embodiment.

In the alternate embodiment of FIG. 5, like elements for the embodiment of FIGS. 1 and 2 are denoted by the same reference numeral but followed by a triple prime (''').

The clutch B includes a unitary plastic clutch block 30''' which defines a cylindrical bearing surface 32''' therein. The bearing surface closely approximates the exterior diameter of the slide tube A but provides a sliding and rotational fit therebetween. A frictional interaction adjusting means 40''' includes a plastic threaded member 42''' which has a smooth, slide tube engaging inner surface 48'''. The threaded member is threadedly received in the unitary clutch block 30''' for selectively locking the sliding and rotational position of the slide tube A therein.

A clutch block mounting means 50''' includes a cylindrical steel mounting block 110 which defines a clutch block receiving bore 112 longitudinally in one end. The clutch block is slidably received in the receiving bore with the bearing surface 32''' in axial alignment with a vertical bore 114 of the mounting block. A set screw 54''' locks a vertical support rod or tube 60''' in the mounting block. For cosmetic purposes, the mounting block 110 is coated with a decorative coating material 116, such as electroplated brass. The support tube 60''' includes an analogous coating 118, such as electroplated brass. The slide tube includes an electroplated brass coating 22'''.

A guide member 70''' is constructed of steel with a decorative coating 120, such as electroplated brass. The guide member defines apertures or bores 72''' and 74''' for receiving the support rod 60''' and the slide tube, respectively. An anchoring means such as a set screw 76''' anchors the guide member to one of the support rod and the slide tube.

Figure 6:
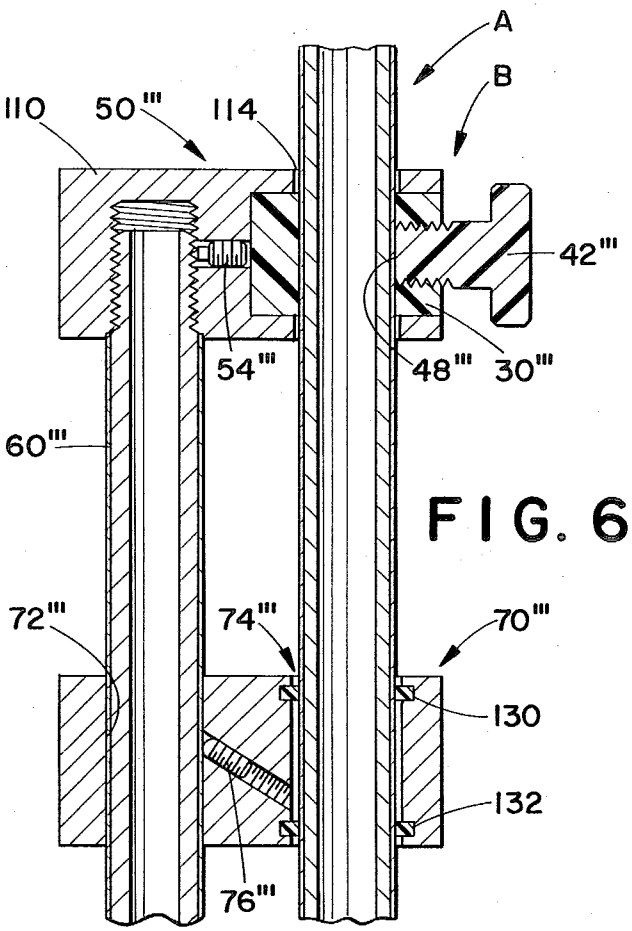
FIG. 6 is a variation on the alternate embodiment of FIG. 5.

The embodiment of FIG. 6 is substantially the same as the embodiment of FIG. 5 except that the slide tube receiving bore 74''' of the slide member 70''' includes a non-abrasive guide means for the slidably received slide tube. In the illustrated embodiment, the slide passage 74''' is widened to define a pair of grooves for receiving a pair of non-abrasive, plastic split rings 130, 132. The non-abrasive split rings are held in vertical position by the grooves in the slide passage and springingly contract to engage the surface of the slide tube sufficiently to maintain the slide tube out of contact with the spacer member 70'''. Further, the set screw 76''' for anchoring the vertical support rod or tube 60 is accessible through the slide tube receiving bore such that it is obscured after assembly.

The invention has been described with reference to the preferred embodiments. Obviously, alterations and modifications will occur to others upon reading and understanding the preceding specification. It is intended that the claims be interpreted as including all such alterations and modifications insofar as they come within the scope of the appended claims or the equivalents thereof.

Having thus described the preferred embodiments, the invention is now claimed to be:

1. A pharmacy style lamp assembly comprising:

a finished metal tube including a vertically disposed lower tube portion having a finished surface and a light bulb receiving socket connected with an upper tube portion, the upper and lower tube portions defining a closed internal passage through which a power cord extends;

a unitary clutch block constructed completely of a non-abrasive material which is sufficiently softer than the finished surface to prevent the tube from being scratched by sliding interaction between the clutch block and the finished metal tube lower portion, the clutch block defining a vertical passage in which the lower tube portion is rotatably and slidingly received, the vertical passage being integrally defined by the non-abrasive clutch block material such that the finished metal tube is not scratched during rotating and sliding, the clutch block further defining a threaded bore therethrough transverse to and intersecting the vertical passage;

a threaded member having an inner end of the non-abrasive material and a manual grasping portion on an outer end, the threaded member being threadedly received in the threaded bore with the non-abrasive inner end directly and frictionally engaging the lower tube portion such that rotating the threaded member adjusts frictional engagement with the lower tube portion, whereby resistance to rotational and sliding movement of the finished metal tube is selectively adjusted; and, a support means for supporting the unitary clutch block.

2. The lamp assembly as set forth in claim 1 wherein the clutch block is machined from a single block of plastic.

3. The lamp assembly as set forth in claim 2 wherein the threaded member is machined from a single piece of plastic.

4. The lamp assembly as set forth in claim 3 wherein the threaded member inner end is smooth and planar.

5. The lamp assembly as set forth in claim 4 wherein the finished metal tube is brass plated.

6. The lamp assembly as set forth in claim 1 wherein the support means includes a wall bracket for mounting to a wall and a pair of threaded connectors which are received through apertures in the wall plate and which are threadedly received in a pair of threaded bores in the clutch block for connecting the clutch block to the wall bracket.

7. A pharmacy style lamp assembly comprising:

a support means for supporting the lamp assembly on an associated structure;

a cylindrical bearing surface which is defined by and integral with a clutch block, the clutch block being mounted with the supporting means such that a central axis of the cylindrical bearing surface is vertically disposed;

a generally L-shaped tube having a lower portion slidably and rotatably received within the cylindrical bearing surface, an upper portion for supporting a socket assembly, and a hollow, internal passaage for receiving a power cord;

the clutch block being integrally constructed of a material which is non-abrasive relative to a surface of the L-shaped tube lower portion such that sliding and rotational movement of the tube lower portion within the cylindrical bearing surface does not scratch the tube lower portion surface; and, a frictional engagement adjusting means for adjusting an amount of frictional engagement between the tube lower portion and the clutch block to facilitate rotary and sliding adjustment of the L-shaped tube relative to the clutch block.

8. The lamp assembly as set forth in claim 7 wherein the support means includes a vertical member which extends between a base that rests on the associated structure and a mounting means for mounting the clutch block to the vertical member.

9. The lamp assembly as set forth in claim 8 wherein the mounting means includes a bore in the clutch block in which the vertical member is anchored.

10. The lamp assembly as set forth in claim 9 further including a spacer member having a pair of apertures therethrough, one of the apertures receiving the vertical member and the other aperture receiving the lower tube portion, the spacer member being slidably received on one of the lower tube portion and the vertical member and fixedly connected to the other.

11. The lamp assembly as set forth in claim 9 wherein the mounting means includes a mounting block that defines a horizontal bore for receiving the clutch block and a vertical bore for receiving the vertical member.

12. The lamp assembly as set forth in calim 7 wherein the L-shaped tube is coated, the clutch block being a material which is non-abrasive to the L-shaped tube coating.

13. The lamp assembly as set forth in claim 12 wherein the clutch block is constructed of a plastic material.

14. The clutch block as set forth in claim 13 wherein the clutch block is coated with a decorative coating material.

15. The lamp assembly as set forth in claim 7 wherein the frictional engagement adjusting means includes a threaded member that is threadedly received in a threaded bore defined in the clutch block, which threaded bore extends through the cylindrical bearing surface such that the threaded member engages the L-shaped tube lower portion.

16. The lamp assembly as set forth in claim 15 wherein the threaded member includes a spring biased ball at an inner end thereof, which ball elements engages the L-shaped tube lower portion.

17. The lamp assembly as set forth in claim 15 wherein the threaded member is constructed of the non-abrasive material and has a smooth inner end which smooth inner end engages the L-shaped tube lower portion.

18. A clutch block assembly for a pharmacy style lamp, the clutch block assembly including:

a cylindrical bearing surface which is defined by and integral with a unitary, plastic clutch block, the clutch block defining a threaded bore which extends transverse to a central axis of the cylindrical bearing surface;

a threaded member which has a threaded, plastic inner end which is threadedly received in the clutch block threaded bore for selectively engaging a tubular member received therein, the threaded member having a manually graspable portion at an outer end thereof to facilitate manual adjustment and positioning of the threaded element inner end; and, mounting means operatively connected with the clutch block for mounting the clutch block to a support means for supporting the clutch block on an associated structure.

19. A clutch block assembly as set forth in claim 18 wherein the clutch block has a major length extending transverse to the cylindrical bearing surface and wherein the mounting means includes a bore defined in the clutch block parallel to the cylindrical bearing surface.

20. The clutch block assembly as set forth in claim 19 further including a spacer member which defines a pair of passages in parallel therethrough, one of the passages being in axial alignment with the cylindrical bearing surface and the other passage being defined in axial alignment with the bore.

* * * * *